US009241556B2

(12) United States Patent
Lee

(10) Patent No.: US 9,241,556 B2
(45) Date of Patent: Jan. 26, 2016

(54) HAIR DRYER CAPABLE OF ADJUSTING VOLUME OF UNHEATED AIR DISCHARGED AT SAME TIME AS HOT AIR

(71) Applicant: Young Jin Lee, Ulsan (KR)

(72) Inventor: Young Jin Lee, Ulsan (KR)

( * ) Notice: Subject to any disclaimer, the term of this patent is extended or adjusted under 35 U.S.C. 154(b) by 0 days.

(21) Appl. No.: 14/403,429

(22) PCT Filed: May 24, 2013

(86) PCT No.: PCT/KR2013/004577
§ 371 (c)(1),
(2) Date: Nov. 24, 2014

(87) PCT Pub. No.: WO2013/180426
PCT Pub. Date: Dec. 5, 2013

(65) Prior Publication Data

US 2015/0113823 A1 Apr. 30, 2015

(30) Foreign Application Priority Data

May 31, 2012 (KR) ..... 10-2012-0057813

(51) Int. Cl.

| | |
|---|---|
| ***A45D 20/12*** | (2006.01) |
| ***A45D 20/08*** | (2006.01) |
| ***A45D 20/10*** | (2006.01) |
| *A45D 20/26* | (2006.01) |

(52) U.S. Cl.
CPC ..... *A45D 20/08* (2013.01); *A45D 20/10* (2013.01); *A45D 20/12* (2013.01); *A45D 20/26* (2013.01)

(58) Field of Classification Search
CPC ..... A45D 20/00; A45D 20/10; A45D 20/12; F26B 3/00; F26B 3/34; D06F 58/00; D06F 58/10; F24H 9/00; F24H 9/2085; F24H 3/00; F24H 3/105
USPC ..... 34/97, 98, 99, 100; 132/8, 132; 392/384, 385
See application file for complete search history.

(56) References Cited

U.S. PATENT DOCUMENTS

| | | | | | |
|---|---|---|---|---|---|
| 2,397,091 | A | * | 3/1946 | Davis | 34/569 |
| 3,916,870 | A | * | 11/1975 | Beavers | 126/110 B |
| 3,943,329 | A | * | 3/1976 | Hlavac | 392/379 |
| 4,307,701 | A | * | 12/1981 | Balon et al. | 126/110 B |
| 4,366,368 | A | * | 12/1982 | Stephens, III | 392/385 |
| 4,712,313 | A | * | 12/1987 | Gettleman | 34/97 |
| 5,157,757 | A | * | 10/1992 | McDougall | 392/383 |
| 5,344,314 | A | * | 9/1994 | Zagoroff et al. | 432/222 |
| 5,369,892 | A | * | 12/1994 | Dhaemers | 34/275 |
| 5,546,678 | A | * | 8/1996 | Dhaemers | 34/275 |
| 5,608,975 | A | * | 3/1997 | Hsu | 34/97 |
| 5,727,331 | A | * | 3/1998 | Thaler et al. | 34/97 |

(Continued)

FOREIGN PATENT DOCUMENTS

| | | | | | |
|---|---|---|---|---|---|
| DE | 4109775 | A1 | * | 10/1991 | |
| GB | WO 2014006365 | A1 | * | 1/2014 | A45D 20/12 |

(Continued)

*Primary Examiner* — Stephen M Gravini
(74) *Attorney, Agent, or Firm* — Jefferson IP Law, LLP

(57) ABSTRACT

According to the hair dryer of the present invention, which is capable of adjusting the volume of unheated air discharged at the same time as hot air; the hot air is discharged through a first discharge outlet and, simultaneously, the unheated air is discharged through a second discharge outlet, and damage to hair caused by hot drying can be prevented by alternately using the hot air and the unheated air while the hair dryer is in use.

10 Claims, 8 Drawing Sheets

(56) References Cited

U.S. PATENT DOCUMENTS

| | | | | | |
|---|---|---|---|---|---|
| 5,839,204 | A * | 11/1998 | Cinque et al. | | 34/97 |
| 5,839,205 | A * | 11/1998 | Hung | | 34/97 |
| 5,875,562 | A * | 3/1999 | Fogarty | | 34/97 |
| 6,003,239 | A * | 12/1999 | Liebenthal et al. | | 34/97 |
| 7,428,785 | B2 * | 9/2008 | Kim | | 34/96 |
| 8,782,920 | B2 * | 7/2014 | Marthinsen et al. | | 34/97 |
| 2006/0196075 | A1 * | 9/2006 | Santhouse et al. | | 34/96 |
| 2006/0236557 | A1 * | 10/2006 | Bousfield | | 34/96 |
| 2013/0276321 | A1 * | 10/2013 | Courtney | A45D | 20/00 34/97 |
| 2014/0007448 | A1 * | 1/2014 | Courtney | A45D | 20/12 34/97 |
| 2014/0007449 | A1 * | 1/2014 | Courtney | A45D | 20/12 34/97 |
| 2014/0144037 | A1 * | 5/2014 | Hadden | | 34/97 |
| 2015/0007443 | A1 * | 1/2015 | Gammack et al. | | 34/97 |
| 2015/0113823 | A1 * | 4/2015 | Lee | | 34/97 |

FOREIGN PATENT DOCUMENTS

| | | | |
|---|---|---|---|
| GB | 2511219 | * | 4/2014 |
| JP | 2000-004930 | A | 1/2000 |
| JP | 2000-201723 | A | 7/2000 |
| JP | 3084386 | U9 | 12/2001 |
| JP | 2013212386 | A * | 10/2013 |
| KR | 10-2004-0060800 | A | 7/2004 |
| KR | 10-2007-0041156 | A | 4/2007 |
| WO | WO 2011016729 | A1 * | 2/2011 |
| WO | WO 2013/144573 | * | 10/2012 |

* cited by examiner

HAIR DRYER CAPABLE OF ADJUSTING VOLUME OF UNHEATED AIR DISCHARGED AT SAME TIME AS HOT AIR

TECHNICAL FIELD

The present invention relates, in general, to a hair dryer which is capable of adjusting the volume of unheated air discharged along with hot air and, more particularly, to a hair dryer, which includes a first outlet discharging hot air and a second outlet mounted to be spaced apart therefrom and discharging unheated air, and adjusts the opening or closing of the second outlet using a push button and a slide holder while the hot air is discharged from the first outlet, thus allowing the volume of the discharged unheated air to be continuously adjusted.

BACKGROUND ART

A hair dryer is a kind of beauty care tool, which is intended to blow cooling air or hot air over wet hair so as to dry the hair or to create a hairstyle as desired.

FIG. 1 is a view showing a general hair dryer. Referring to FIG. 1, the general hair dryer 10 is mainly composed of a casing 12, a blowing fan 16, an outlet 18, a handle 20, a switch 22, and a power supply cord 24.

The blowing fan 16 is rotated by a driving motor, and the body 12 has therein a heater coil that generates heat by supplied power and a safety means that prevents the heater coil from overheating. The general hair dryer is operated based on the following operational principle: outside air is drawn into the casing 12 by means of the blowing fan 16, and then is heated while passing through the heater coil, and finally the heated air is discharged through the outlet 18. A user may dry or style his or her hair using the hot air that is discharged according to the above-mentioned principle.

On one hand, if the hair is exposed to the hot air for a lengthy period of time when the hair is dried or styled via the hair dryer 10, it causes the hair to be excessively dried, thus leading to split ends or damage to the hair. Hence, it is necessary to alternately use hot air and cooling air or unheated air.

Further, in the case where a hairdresser uses the hair dryer 10 for a lengthy period of time, the handle 20 mounted to a lower portion of the hair dryer as well as a portion of the casing 12 between the outlet 18 and the blowing fan 16 serves as a handle. However, when the portion of the casing 12 is held by the hand to be used, it is very inconvenient to control the switch 22 while adjusting air blowing due to the position of the switch 22.

Therefore, there is a need for developing a hair dryer, which is capable of efficiently discharging alternately the cooling air or the unheated air along with the hot air, and which allows a user to easily adjust the air blowing over a prolonged period of time.

As the technology relating to the hair dryer, Korean Patent No. 10-0474007, which is entitled a hair dryer using heated fluid as a heat source, is disclosed. According to the cited document, the hair dryer uses heated fluid as the heat source for heating the hair.

DISCLOSURE

Technical Problem

Accordingly, the present invention has been made keeping in mind the above problems occurring in the related art, and is intended to provide a hair dryer which is capable of discharging hot air through a first outlet and of discharging unheated air through a second outlet.

Further, the present invention is intended to provide a hair dryer which is capable of adjusting the volume of unheated air discharged from a second outlet by adjusting the opening or closing of the second outlet using a second switch.

Furthermore, the present invention is intended to provide a hair dryer which is configured such that a second switch is mounted to a region where a user can easily adjust the blowing of unheated air for a lengthy period of time, in addition to an existing switch region.

Further, the present invention is intended to provide a hair dryer, in which a second switch is composed of a push button and a slide holder to control the opening or closing of a second outlet, and which is capable of continuously adjusting the volume of air discharged from the second outlet.

Technical Solution

In an aspect, the present invention provides a hair dryer capable of adjusting a volume of unheated air discharged along with hot air, the hair dryer including a blowing fan rotated by a motor to introduce outside air; a body including a heater coil that heats the introduced air; a first outlet provided on a first side of the body to discharge air that is heated by the heater coil; a first handle provided on a lower portion of a second side of the body, with a first switch mounted on the first handle to drive the motor and the heater coil; a second outlet provided on a predetermined portion of the body in such a way as to be opposite to the first outlet, the second outlet discharging the introduced and pressurized air by the blowing fan; and a second switch controlling opening or closing of the second outlet and adjusting a volume of the discharged air.

Preferably, the second outlet may include an outer housing mounted to an inside of the body and being open at a surface thereof; a spring mounted to an inside of the outer housing in such a way as to be opposite to the open surface of the outer housing; and an elastic opening plate connected to the spring to open the surface of the outer housing to an outside by an elastic action of the spring.

More preferably, the second switch may include a push button pressed by a user so as to discharge air from the second outlet; and a push wire operated in conjunction with the push button to pressurize the elastic opening plate by a user's pressing force.

Preferably, the second switch may be operated such that, if the user presses the push button down, the push wire operated in conjunction with the push button pushes the elastic opening plate and thereby the spring is compressed, with the result that the surface of the outer housing is open to the outside and the pressurized air is discharged.

More preferably, the second switch may be operated such that, if the user presses and releases the push button, the compressed spring is restored to an original state thereof and thereby the elastic opening plate closes the surface of the outer housing, thus preventing air from being discharged from the surface of the outer housing.

More preferably, the second switch may be operated such that, if a magnitude of force of pressing the push button is adjusted, an elastic force of the spring operated in conjunction with the push button is changed, thus adjusting an opening of the outer housing to the outside by the elastic opening plate, and thereby adjusting a volume of the pressurized air that is discharged from the surface of the outer housing.

Preferably, while the first outlet discharges the hot air, the second outlet may pressurize some of the air introduced by the blowing fan and may discharge the pressurized unheated air.

More preferably, the second outlet may include an outer housing mounted to an inside of the body and being open at a surface thereof; a spring mounted to an inside of the outer housing in such a way as to be opposite to the open surface of the outer housing; an electromagnet mounted to an outside of the outer housing and magnetized when an electric current flows through the electromagnet; and an electromagnet opening plate mounted to the inside of the outer housing in such a way as to be connected to the spring, the electromagnet opening plate opening the surface of the outer housing to an outside by an attractive-force action of the electromagnet.

Preferably, the second switch may include a push button pressed by a user so as to discharge air from the second outlet; and a conductive wire operated in conjunction with the push button to cause the electric current to flow through the electromagnet by the user's pressing operation.

More preferably, the second outlet may include an outer housing mounted to an inside of the body and being open at upper and lower surfaces thereof; a rotary opening plate partially supported in the outer housing; and a spring mounted between an inner wall of the outer housing and the rotary opening plate, wherein the rotary opening plate may be connected to the spring to open the upper and lower surfaces of the outer housing to an outside by an elastic action of the spring.

Advantageous Effects

As described above, the hair dryer capable of adjusting the volume of the unheated air discharged along with the hot air according to the present invention is advantageous in that the hot air is discharged through the first outlet and simultaneously the unheated air is discharged through the second outlet, thus allowing the hot air and the unheated air to be alternately utilized when the hair dryer is in use and thereby preventing the hair from being damaged due to heat drying.

Further, the hair dryer according to the present invention is advantageous in that the hair is rolled on the roll brush and then the hot air as well as the cooling air of the continuously adjusted discharge volume is blown to the hair so as to create a desired hairstyle by fixing the hair, thus making relatively strong fixing or weak fixing for the hair curl.

Furthermore, the hair dryer according to the present invention is advantageous in that the second switch is mounted to a certain region of the body in addition to the existing switch region, thus allowing a user to easily adjust the blowing of the unheated air for a lengthy period of time.

Further, the hair dryer according to the present invention is advantageous in that the second switch is mounted to efficiently control the opening or closing of the second outlet, and the second switch is composed of the push button and the slide holder, thus allowing the volume of air discharged from the second outlet to be continuously adjusted.

DESCRIPTION OF REFERENCE NUMERALS OF IMPORTANT PARTS

Figure 1:
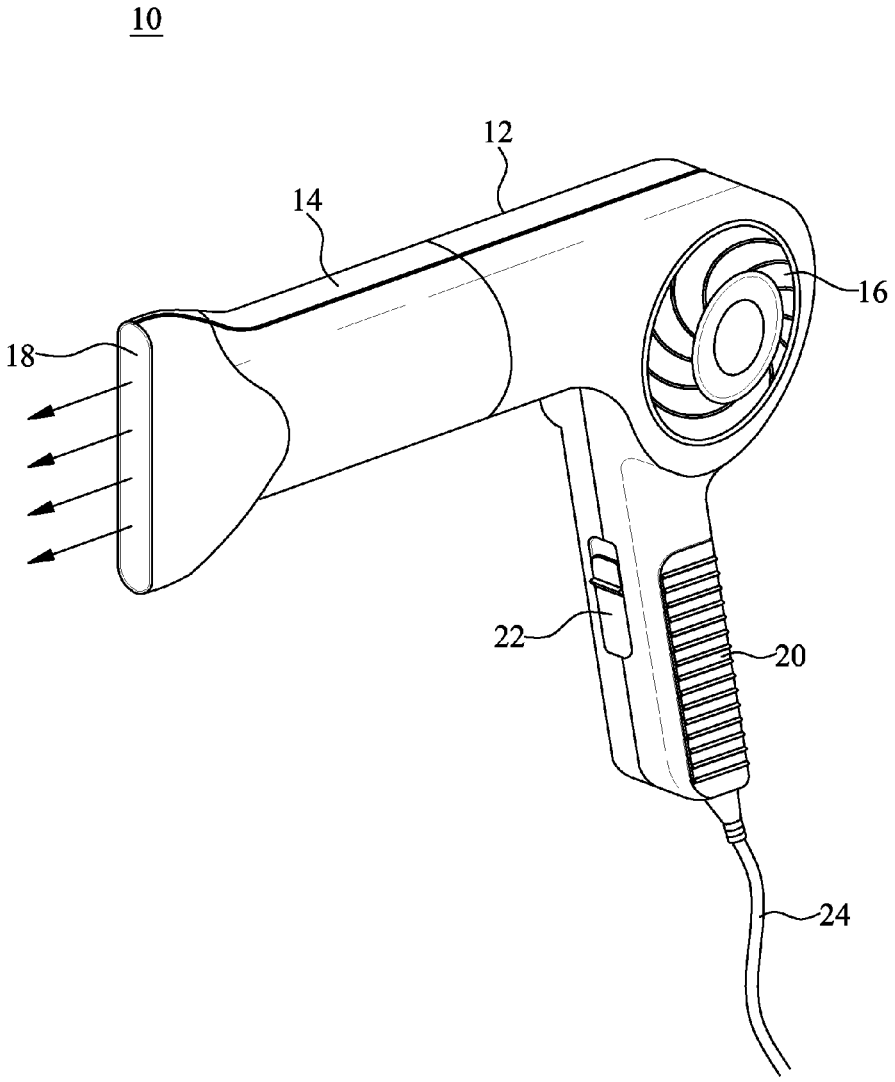
FIG. 1 is a view showing a general hair dryer.

| | |
|---|---|
| 100: hair dryer according to an embodiment of the present invention | |
| 110: blowing fan | 120: body |
| 130: first outlet | 140: first switch |
| 150: first handle | 160: second outlet |
| 162: outer housing | 164: spring |
| 166: elastic opening plate | 170: second switch |
| 172: push button | 173: push wire |
| 174: slide holder | |

BEST MODE

Hereinafter, the present invention will be described in detail with reference to the accompanying drawings. Exemplary embodiments of the present invention will be provided to make the present invention be more completely understood by those skilled in the art. In the following description, if it is decided that the detailed description of known function or configuration related to the invention makes the subject matter of the invention unclear, the detailed description is omitted. Like reference numerals designate like elements throughout the specification.

In addition, it will be understood that, when an element is referred to as being connected to another element, they may be 'directly connected' to each other, and besides be 'indirectly connected' to each other with an intervening element disposed therebetween. Further, the meaning of 'including an element' does not exclude the possibility of further including another element unless otherwise stated.

Figure 2:
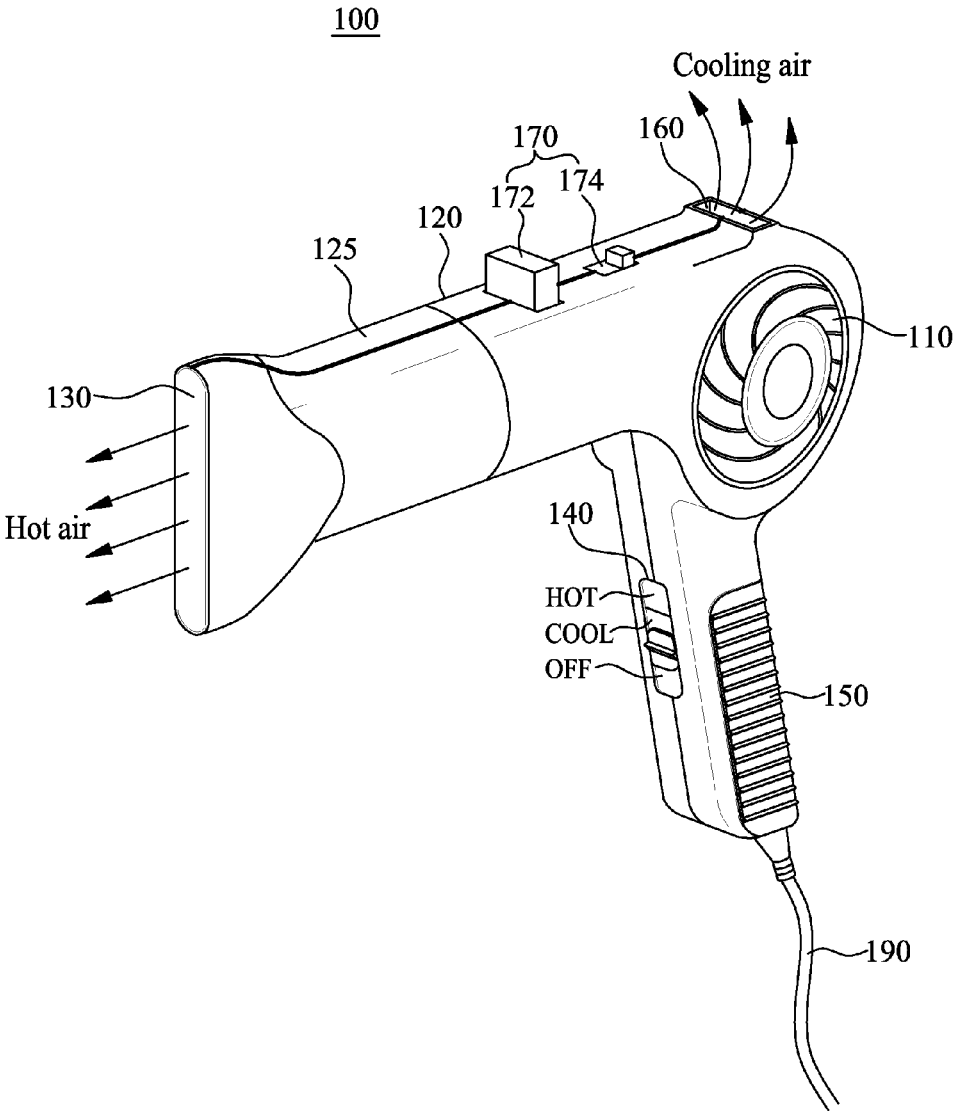
FIG. 2 is a schematic view showing a hair dryer according to an embodiment of the present invention.

FIG. 2 is a schematic view showing a hair dryer according to an embodiment of the present invention. Referring to FIG. 2, the hair dryer 100 according to the embodiment of the present invention may include a blowing fan 110, a body 120, a first outlet 130, a first switch 140, a first handle 150, a second outlet 160 and a second switch 170.

The blowing fan 110 is rotated by a motor (not shown) to introduce outside air into the body 120. Both the blowing fan 110 and the motor may be installed in the body 120.

The body 120 may include a coil-shaped heater coil (not shown) for heating air introduced by the blowing fan 110. The first outlet 130 is provided on a side of the body 120 to discharge hot air that is heated via the heater coil, while the second outlet 160 is provided on another side of the body 120 opposite to the first outlet 130. The second switch 170 may be provided at a predetermined region of the body 120 between the first and second outlets 130 and 160. In addition, a bimetal mechanism (not shown) may be further provided to prevent the overheating of the heater coil.

The first outlet 130 may be provided on an edge of the body 120. The air introduced by the blowing fan 110 may lead to the discharge of the hot air that is heated by the heater coil.

The first switch 140 may be mounted to a predetermined region of the first handle 150. The first switch 140 is switched between a turn-on mode and a turn-off mode to select the driving of the hair dryer 100. Further, it is possible to select hot or cooling air which is to be discharged through the first outlet 130 by means of the first switch 140.

The first handle 150 may be mounted to a lower portion of the body 120 in such a way as to be opposite to the first outlet 130, and may be formed to be easily gripped by a user's hand.

The second outlet 160 is mounted to a predetermined region of the body 120 in such a way as to be opposite to the first outlet 130, and serves to discharge air that is introduced by the blowing fan 110 and then is pressurized. That is, some of the air introduced by the blowing fan 110 may pass through the body 120 and then may be discharged out through the first outlet 130, while the rest of the air may be pressurized by the blowing fan 110 and then may be discharged out through the second outlet 160.

Here, since the air discharged through the second outlet 160 is pressurized by the rotation of the blowing fan 110, this air may be considered as unheated air that has pressure higher than that of natural air.

The features of the second outlet 160 are as follows: since the unheated air may be discharged through the second outlet 160 while the hot air is discharged through the first outlet, the hot air and the unheated air are alternately utilized during the use of the hair dryer 100 and thereby it is possible to prevent the damage to the hair due to the heat drying.

The second switch 170 is mounted to a predetermined region of the body 110 between the first and second outlets 130 and 160, and serves to control the opening or closing of the second outlet 160, in addition to adjusting the volume of the discharged air.

Generally as for hairdressers who use the hair dryer for a lengthy period of time, they frequently use a body region 125 between the first outlet 130 and the blowing fan 110 as well as the first handle 150 mounted to the lower portion, as the handle of the hair dryer. Hence, the second switch 170 may be mounted to a predetermined region of the body 110 between the first and second outlets 130 and 160, in addition to the region equipped with the first switch 140, thus allowing a user to easily adjust the blowing of the unheated air over a lengthy period of time.

Figure 3:
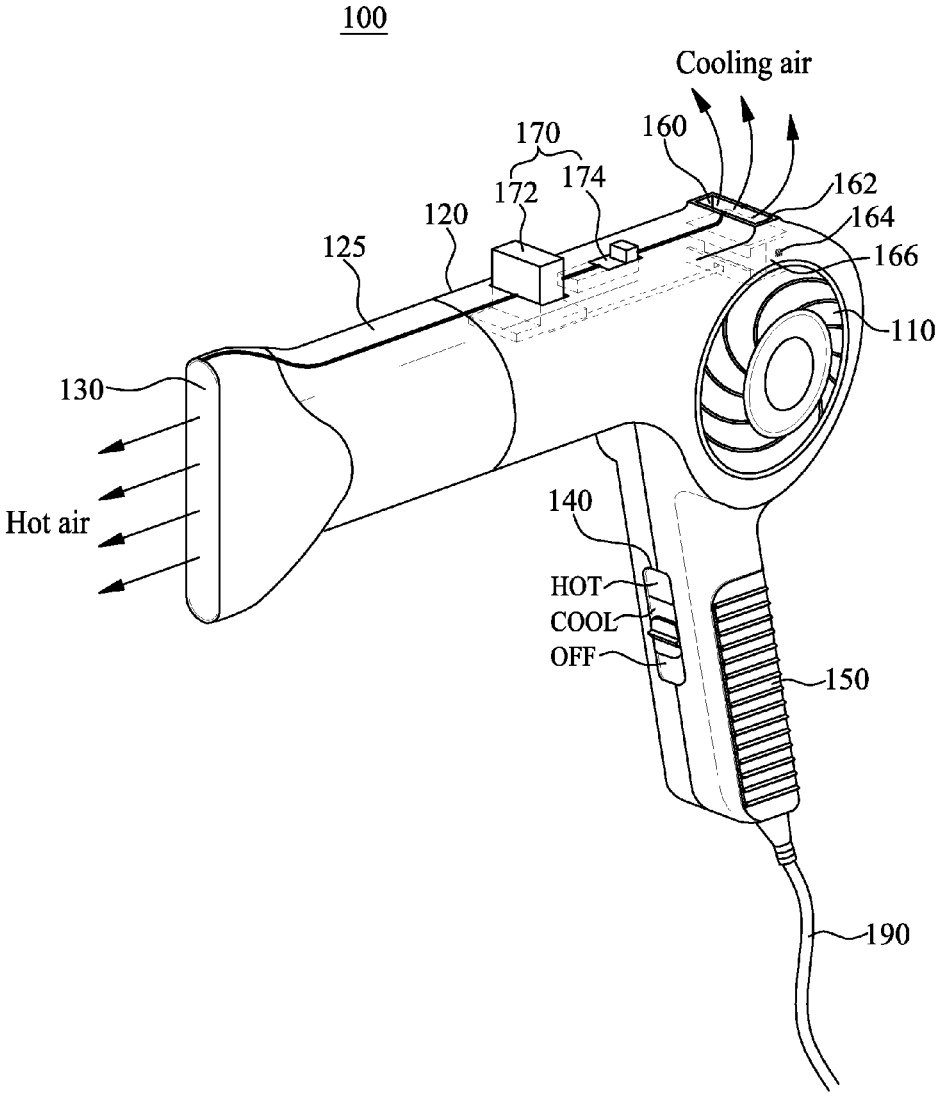
FIG. 3 is a partial perspective view showing the hair dryer according to the embodiment of the present invention.

FIG. 3 is a partial perspective view showing the hair dryer according to the embodiment of the present invention. Referring to FIG. 3, the second outlet 160 includes an outer housing 162, a spring 164, and an elastic opening plate 166. The second switch 170 may include a push button 172, a push wire 173, and a slide holder 174.

The second outlet 160 and the second switch 170 may be mounted to be operated in conjunction with each other. The second switch 170 may serve to control the opening or closing of the second outlet 160 and the volume of the discharged air. Hereinafter, the operation of the second outlet 160 and the second switch 170 will be described in detail with reference to FIGS. 4 to 6.

Figure 4:
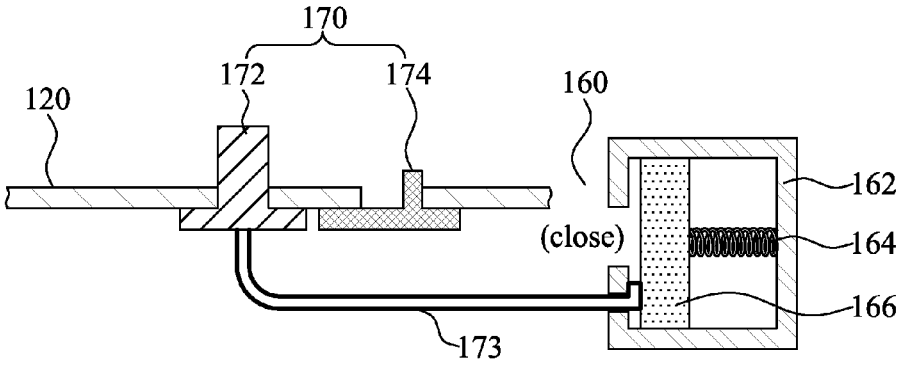
FIG. 4 is a view showing an operation of the hair dryer according to the embodiment of the present invention.
Figure 5:
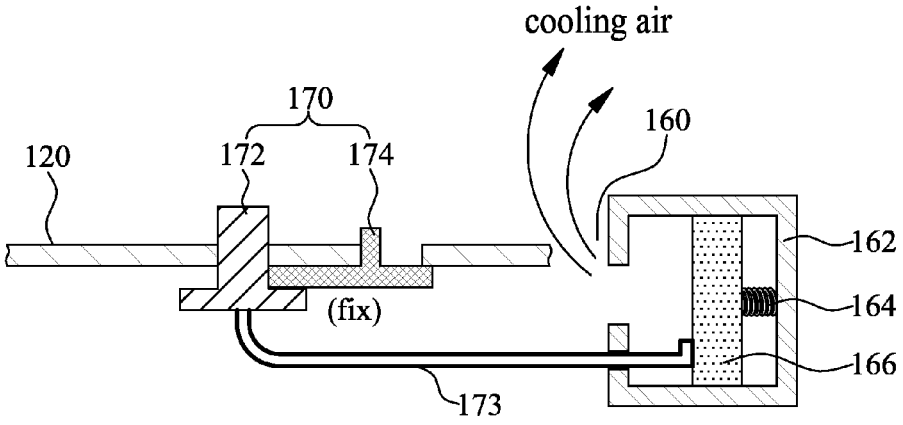
FIG. 5 is a view showing an operation of the hair dryer according to the embodiment of the present invention.
Figure 6:
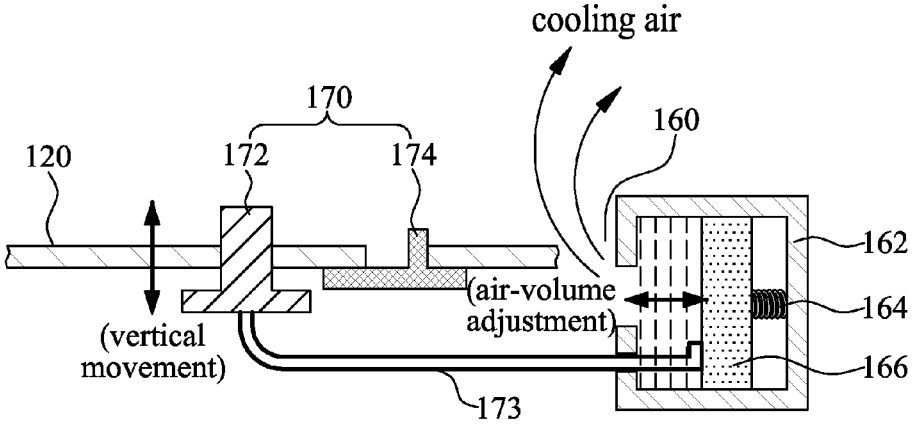
FIG. 6 is a view showing an operation of the hair dryer according to the embodiment of the present invention.

FIGS. 4 to 6 are views showing the operation of the hair dryer according to the embodiment of the present invention.

First, referring to FIG. 4, the outer housing 162 may be mounted to the inside of the body 120 in such a way as to be open at a surface thereof to an outside. The spring 164 may be provided in the outer housing 162 to be opposite to the open surface of the outer housing 162. The elastic opening plate 166 is connected to the spring 164 to open the surface of the outer housing 162 to the outside by the elastic action of the spring 164.

The push button 172 may comprise a button that may be pressed by a user to discharge air out through the second outlet 160. The push wire 173 is operated in conjunction with the push button 172, thus pressing the elastic opening plate 166 by his or her pressing pressure. The slide holder 174 may hold or release the pressing of the push button 172.

In FIG. 4, as the user presses the push button 172 down, the push wire 173 operated in conjunction with the push button 172 pushes the elastic opening plate 166. Thereby, the spring 164 is compressed, so that the surface of the outer housing 162 is opened to the outside, and the pressurized air is discharged by the blowing fan 160.

Further, as shown in the drawing, the slide holder 174 holds the push button 172 in a predetermined pressed state, so that the surface of the outer housing 162 is kept open. Therefore, it is possible to continuously discharge the pressurized air from the surface of the outer housing 162 to the outside.

FIG. 5 illustrates an operation where a user releases the slide holder 174 and then adjusts the magnitude of force of pressing the push button 172 down. Here, as the magnitude of force of pressing the push button 172 down varies, the elastic force of the spring 164 operated in conjunction with the push button 172 varies, thus adjusting the opening of the surface of the outer housing 162 to the outside by means of the elastic opening plate 166. Thereby, it is possible to adjust the volume of the pressurized air that is discharged from the surface of the outer housing 162.

FIG. 6 illustrates an operation where a user presses and releases the push button 172 with the slide holder 174 released. In this case, the compressed spring 164 is restored to its original state, so that the elastic opening plate 166 closes the open surface of the outer housing 162, thus stopping the discharge of the air from the surface of the outer housing 162.

As such, in the hair dryer according to the embodiment of the present invention, while hot air is discharged through the first outlet 130, unheated air is discharged through the second outlet 160. Therefore, it is possible to alternately use the hot air and the unheated air during the use of the hair dryer, thus preventing the damage to the hair due to the heat drying.

Further, for example, the hair is rolled on a roll brush and then the hot air as well as the cooling air of the continuously adjusted discharge volume is blown to the hair so as to create a desired hairstyle by fixing the hair, thus making relatively strong fixing or weak fixing for the hair curl.

Further, according to the embodiment of the present invention, in addition to the existing switch region 140, the second switch 170 is mounted to a predetermined region of the body 120, thus allowing a user to easily adjust the blowing of the unheated air over a lengthy period of time.

Furthermore, according to the embodiment of the present invention, it is possible to efficiently control the opening or closing of the second outlet 160 by mounting the second switch 170, and it is possible to continuously adjust the volume of the air discharged from the second outlet 160 by the second switch 170 composed of the push button 172 and the slide holder 174.

Figure 7:
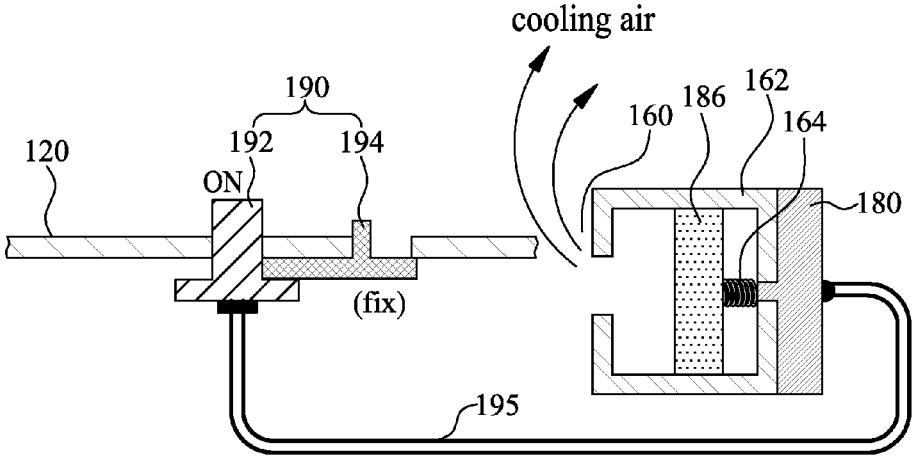
FIG. 7 is a view showing an operation of a hair dryer according to another embodiment of the present invention.

FIG. 7 is a view showing an operation of a hair dryer according to another embodiment of the present invention. Since elements common to both the embodiments have the same function, they will not be described in detail. Referring to FIG. 7, the second outlet 160 is mounted to the inside of the body 120, and may include an outer housing 162 that is open at a surface thereof, a spring 164 that is provided in the outer housing 162 in such a way as to be opposite to the open surface of the outer housing 162, an electromagnet 180 that is mounted to the outside of the outer housing 162 and exhibits conductivity when an electric current flows therethrough, and an electromagnet opening plate 186 that is provided in the outer housing 162 to be connected to the spring 164 and serves to open the surface of the outer housing 180 to the outside by the attractive-force action of the electromagnet 180.

A third switch 190 may include a push button 192 that is pressed by a user to discharge air from the second outlet 160, a conductive wire 195 that is operated in conjunction with the push button 192 and allows an electric current to flow through the electromagnet 180 when he or she presses the push button, and a slide holder 194 that holds the pressing of the push button 192 and allows the electric current to continuously flow through the electromagnet 180.

Figure 8:
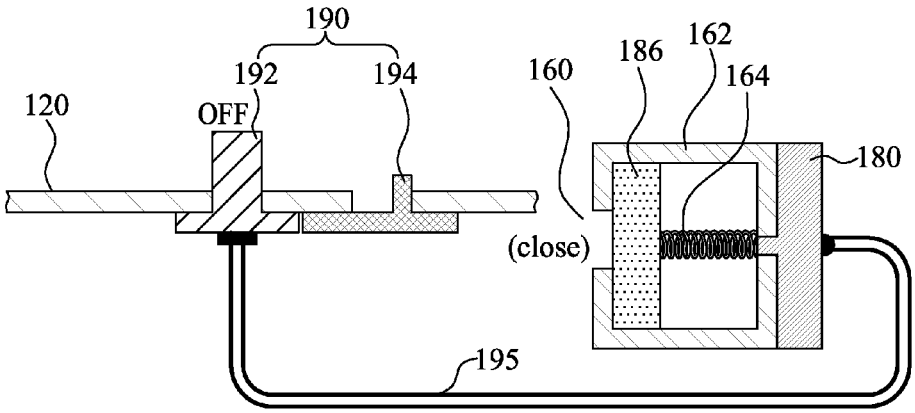
FIG. 8 is a view showing an operation of the hair dryer according to the embodiment of the present invention.

Hereinafter, the operation of the hair dryer according to another embodiment of the present invention will be described in detail. FIGS. 7 and 8 are views showing the operation of the hair dryer according to another embodiment of the present invention.

First, referring to FIG. 7, as a user presses the push button 192 down, the conductive wire 195 operated in conjunction with the push button 192 causes the electric current to flow through the electromagnet 180. As the electric current flows through the electromagnet 180, an attractive force is generated between the electromagnet 180 and the electromagnet opening plate 186. By the attractive force, the electromagnet opening plate 186 is attracted to the electromagnet 180, thus opening the outer surface of the outer housing 180.

Here, as the slide holder 194 holds the push button 192 in the pressed state and causes the electric current to continuously flow through the electromagnet 180, the attractive force is maintained between the electromagnet opening plate 186 and the electromagnet 180. Thereby, it is possible to continuously discharge the air pressurized by the blowing fan 160 from the surface of the outer housing 162 to the outside.

Next, FIG. 8 illustrates an operation where a user presses and releases the push button 192 with the slide holder 194 released. If he or she presses and releases the push button 192, the electric current flowing through the electromagnet 180 is cut off, so that attractive force acting between the electromagnet 180 and the electromagnet opening plate 186 is dissipated. Thereby, the electromagnet opening plate 186 closes the open surface of the outer housing 162, thus stopping the discharge of the air from the outer housing 162.

Figure 9:
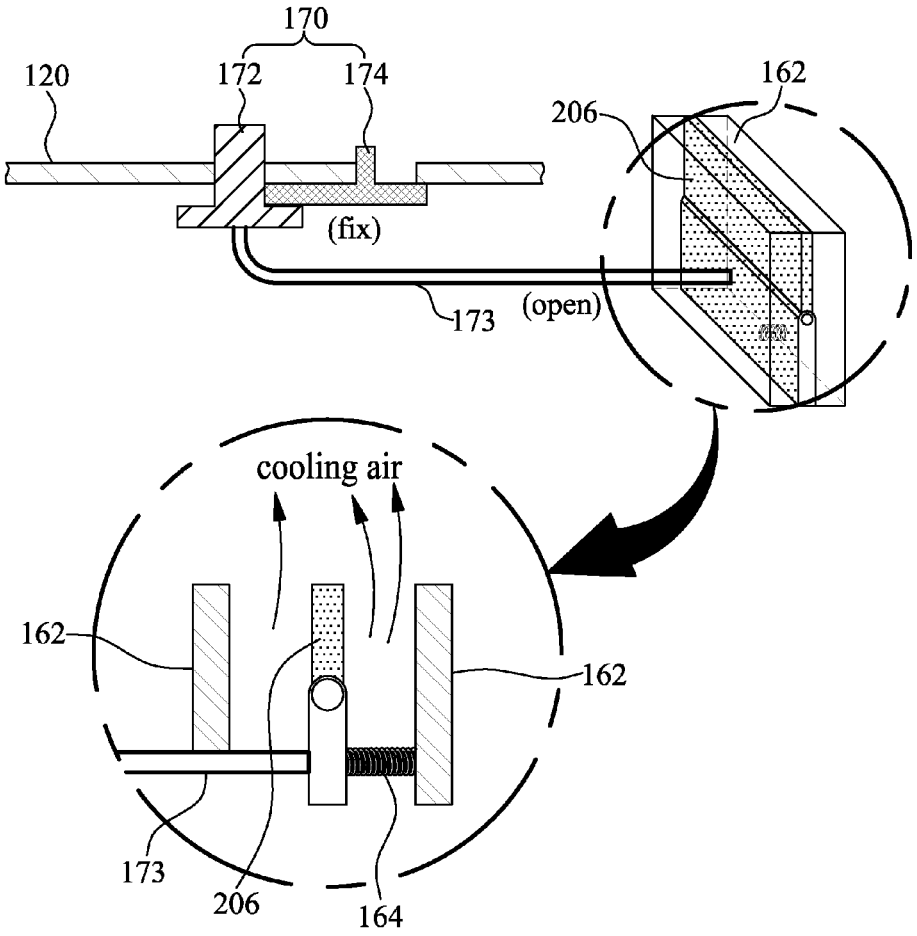
FIG. 9 is a view showing an operation of the hair dryer according to the embodiment of the present invention.
Figure 10:
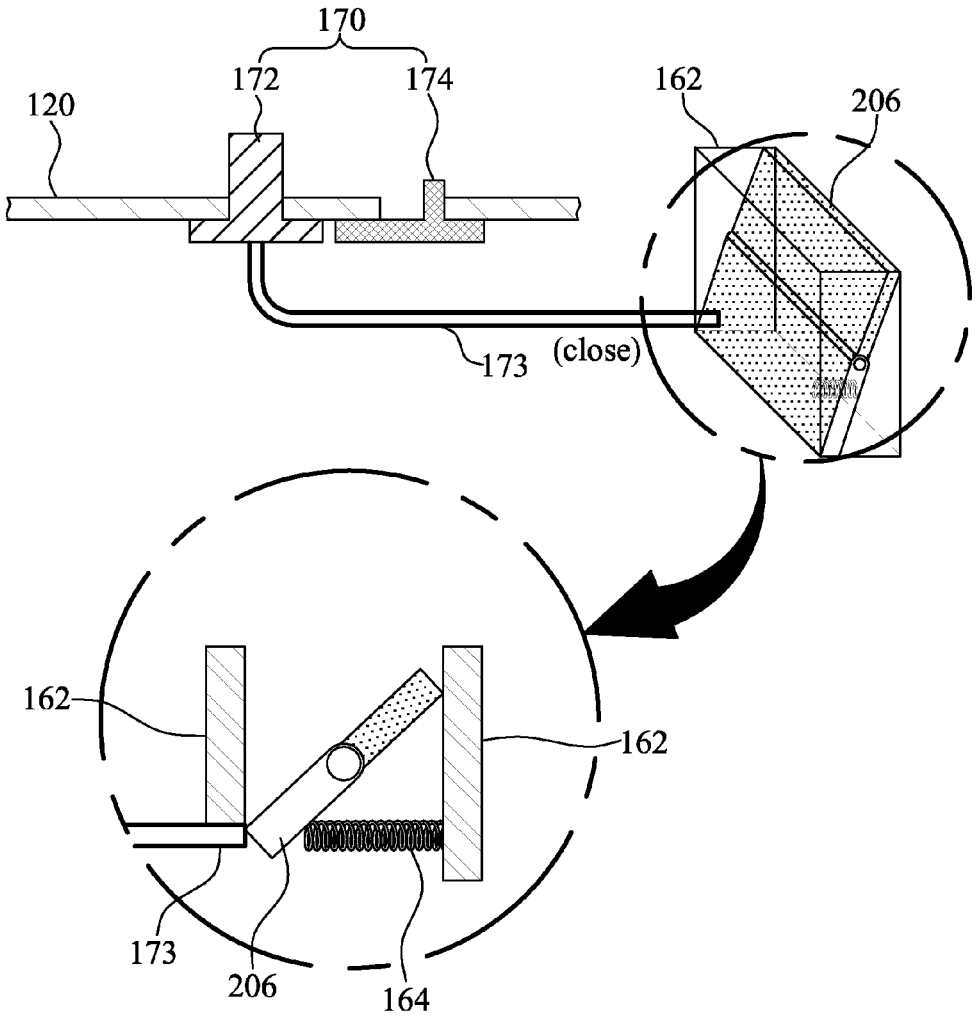
FIG. 10 is a view showing an operation of the hair dryer according to the embodiment of the present invention.

FIGS. 9 and 10 are views showing an operation of the hair dryer according to the embodiment of the present invention. Since elements common to both the embodiments have the same function, they will not be described in detail. Referring to FIGS. 9 and 10, the second outlet 160 is mounted to the inside of the body 120, and may include an outer housing 162 that is open at upper and lower surfaces thereof and a rotary opening plate 206 that is mounted to be supported by a portion of a sidewall in the outer housing 162 and is pressed by the push wire 173 to open the upper and lower surfaces of the outer housing 162.

First, referring to FIG. 9, as a user presses the push button 172 down, the push wire 195 operated in conjunction with the push button 192 pushes the rotary opening plate 206, thus compressing the spring 164 mounted between the rear surface of the rotary opening plate 206 and the inner wall of the outer housing 162 and rendering the rotary opening plate 206 to open the upper and lower surfaces of the outer housing 162. As the upper and lower surfaces of the outer housing 162 are opened, it is possible to discharge air pressurized by the blowing fan 160.

Further, the slide holder 174 holds the push button 172 in a pressed state, thus keeping the upper and lower surfaces of the outer housing 162 open, and thereby allowing the pressurized air to be continuously discharged from the upper surface of the outer housing 162 to the outside.

Next, FIG. 10 is a view illustrating an operation where a user presses and releases the push button 172 with the slide holder 174 released. If he or she presses and releases the push button 172, the compressed spring is restored to its original state, so that the rotary opening plate 206 closes the open upper and lower surfaces of the outer housing 162, thus preventing the discharge of the air from the upper and lower surfaces of the outer housing 162.

Although the embodiments of the present invention have been disclosed for illustrative purposes, those skilled in the art will appreciate that various modifications, additions and substitutions are possible, without departing from the scope and spirit of the invention as disclosed in the accompanying claims.

The invention claimed is:

1. A hair dryer capable of adjusting a volume of unheated air discharged along with hot air, the hair dryer comprising:

a blowing fan rotated by a motor to introduce outside air into the hair dryer;

a body including a heater coil that heats the introduced drying air;

a first outlet provided on a first side of the body to discharge air from the hair dryer that is heated by the heater coil;

a first handle provided on a lower portion of a second side of the body, with a first switch mounted on the first handle to drive the motor and the heater coil;

a second outlet provided on a predetermined portion of the body in such a way as to be opposite to the first outlet, the second outlet discharging the introduced and pressurized air by the blowing fan; and a second switch controlling opening or closing of the second outlet and adjusting a volume of the discharged air.

2. The hair dryer according to claim 1, wherein the second outlet comprises:

an outer housing mounted to an inside of the body and being open at a surface thereof;

a spring mounted to an inside of the outer housing in such a way as to be opposite to the open surface of the outer housing; and an elastic opening plate connected to the spring to open the surface of the outer housing to an outside by an elastic action of the spring.

3. The hair dryer according to claim 2, wherein the second switch comprises:

a push button pressed by a user so as to discharge air from the second outlet; and a push wire operated in conjunction with the push button to pressurize the elastic opening plate by a user's pressing force.

4. The hair dryer according to claim 3, wherein the second switch is operated such that, if the user presses the push button down, the push wire operated in conjunction with the push button pushes the elastic opening plate and thereby the spring is compressed, with the result that the surface of the outer housing is open to the outside and the pressurized air is discharged.

5. The hair dryer according to claim 3, wherein the second switch is operated such that, if the user presses and releases the push button, the compressed spring is restored to an original state thereof and thereby the elastic opening plate closes the surface of the outer housing, thus preventing air from being discharged from the surface of the outer housing.

6. The hair dryer according to claim 3, wherein the second switch is operated such that, if a magnitude of force of pressing the push button is adjusted, an elastic force of the spring operated in conjunction with the push button is changed, thus adjusting an opening of the outer housing to the outside by the elastic opening plate, and thereby adjusting a volume of the pressurized air that is discharged from the surface of the outer housing.

7. The hair dryer according to claim 1, wherein, while the first outlet discharges the hot air, the second outlet pressurizes some of the air introduced by the blowing fan and discharges the pressurized unheated air.

8. The hair dryer according to claim 1, wherein the second outlet comprises:

an outer housing mounted to an inside of the body and being open at a surface thereof;

a spring mounted to an inside of the outer housing in such a way as to be opposite to the open surface of the outer housing;

an electromagnet mounted to an outside of the outer housing and magnetized when an electric current flows through the electromagnet; and an electromagnet opening plate mounted to the inside of the outer housing in such a way as to be connected to the spring, the electromagnet opening plate opening the surface of the outer housing to an outside by an attractive-force action of the electromagnet.

9. The hair dryer according to claim 8, wherein the second switch comprises:

a push button pressed by a user so as to discharge air from the second outlet; and a conductive wire operated in conjunction with the push button to cause the electric current to flow through the electromagnet by the user's pressing operation.

10. The hair dryer according to claim 1, wherein the second outlet comprises:

an outer housing mounted to an inside of the body and being open at upper and lower surfaces thereof;

a rotary opening plate partially supported in the outer housing; and a spring mounted between an inner wall of the outer housing and the rotary opening plate, wherein the rotary opening plate is connected to the spring to open the upper and lower surfaces of the outer housing to an outside by an elastic action of the spring.

* * * * *